US005835836A

United States Patent [19]

Hirao

[11] Patent Number: 5,835,836

[45] Date of Patent: Nov. 10, 1998

[54] IMAGE FORMING APPARATUS

[75] Inventor: Naoto Hirao, Kawasaki, Japan

[73] Assignee: Fujitsu Limited, Kanagawa, Japan

[21] Appl. No.: 925,737

[22] Filed: Sep. 9, 1997

[30] Foreign Application Priority Data

Mar. 19, 1997 [JP] Japan ..... 9-066915

[51] Int. Cl.[6] ..... G03G 15/20

[52] U.S. Cl. ..... 399/336; 399/337; 399/341; 430/126

[58] Field of Search ..... 399/335–337, 399/341, 320; 219/216; 430/126

[56] References Cited

U.S. PATENT DOCUMENTS

| | | | |
|---|---|---|---|
| 4,591,884 | 5/1986 | Miyamoto et al. | 347/153 |
| 4,768,057 | 8/1988 | Kumada et al. | 399/336 |
| 4,928,147 | 5/1990 | Baumann et al. | 399/337 |
| 4,946,756 | 8/1990 | Estavoyer et al. | 430/124 |
| 5,113,223 | 5/1992 | Theodoulou et al. | 219/220 |
| 5,448,344 | 9/1995 | Itakura et al. | 399/336 |

FOREIGN PATENT DOCUMENTS

| | | | |
|---|---|---|---|
| 60-014268 | 1/1985 | Japan | 355/288 |
| 60-107671 | 6/1985 | Japan | 355/288 |
| 60-115976 | 6/1985 | Japan | 355/288 |
| 60-107068 | 10/1985 | Japan . | |
| 61-005271 | 1/1986 | Japan | 355/288 |

OTHER PUBLICATIONS

Ronald A. Andrews: "Single Pass Duplex In 1,7,9 Electronic Systems" Xerox Disclosure Journal, vol. 9, No. 1, pp. 47–48, Jan./Feb. 1984.

*Primary Examiner*—Matthew S. Smith

*Attorney, Agent, or Firm*—Armstrong, Westerman, Hattori, McLeland, & Naughton

[57] ABSTRACT

An image forming apparatus is constructed to include a first fixing unit fixing a toner image transferred on a first side of a recording medium by a flash, a second fixing unit fixing a toner image transferred on a second side of the recording medium by a flash, and a leak preventing mechanism for preventing the flash of the first fixing unit to the second side and the flash of the second fixing unit to the first side via a region which is within a fixing region of the first and second fixing units and where no recording medium exists due to a size of the recording medium used.

20 Claims, 12 Drawing Sheets

IMAGE FORMING APPARATUS

BACKGROUND OF THE INVENTION

The present invention generally relates to image forming apparatuses, and more particularly to an image forming apparatus which forms images on both sides of a recording medium such as a recording paper.

Conventionally, there is a known copying machine which employs the electrophotography technique and forms images on both sides of a recording paper using a single process unit. However, since only one process unit is provided to transfer a toner image onto the recording paper, the recording paper must be turned after transferring a toner image onto a first side of the recording paper, and the turned recording paper must then be supplied again to the process unit so as to transfer a toner image onto a second side of the recording paper. For this reason, a duplex unit must be provided to turn the recording paper, thereby making the construction of the copying machine complex, and there was a limit to forming the images on both sides of the recording paper at a high speed.

On the other hand, there is a proposed a printer which employs the electrophotography technique and uses a first process unit exclusively for transferring the toner image onto the first side of the recording paper and a second process unit exclusively for transferring the toner image onto the second side of the recording paper. According to this proposed printer, it is possible to print images on both sides of the recording paper at a high speed, and it is also possible to cope with a continuous recording paper.

In the case of a printer which prints the image on the continuous recording paper, a portion of the paper printed with a last line remains in a paper transport path within the printer if one print operation (job) ends and a next job does not occur for a predetermined time. In this case, the recording paper is fed forward manually or automatically, so that the portion of the paper printed with the last line is ejected outside the printer, thereby making it possible to cut the recording paper along a perforation at a position subsequent to the portion of the paper printed with the last line.

However, when the next job is started in this state, the printing is started in a state where the recording paper precedes the next job by the amount fed forward in order to obtain the print result of the previous job. As a result, the amount of the recording paper fed forward is wasted, thereby making the utilization efficiency of the recording paper poor.

Therefore, conventionally, the recording paper is fed forward as described above if one job ends and the next job does not occur for a predetermined time, and a so-called back-feed is made so as to feed back and return the recording paper by a predetermined amount before the next job starts. In this case, it is possible to improve the utilization efficiency of the recording paper. A photoconductive body of the process unit and the recording paper are separated from each other when making the back-feed.

Similarly, in the case of a printer which successively prints images by the first and second process units, for example, at a time when the first job ends, the last line which is printed is located on a downstream side of the second process unit along the transport direction of the recording paper. For this reason, if the next job is started in this state, a portion of the paper between the first and second process units is wasted. Accordingly, there is a proposal to also make the above described back-feed in this case.

On the other hand, in a case where the fixing unit includes a heat roller which contacts the recording paper and fixes the image by pressure and heat, it is necessary to separate the heat roller from the recording paper when making the above described back-feed, similarly as in the case of the photoconductive body of the process unit. As a result, it is necessary to provide a contacting/separating mechanism with respect to the fixing unit, and the construction of the printer becomes complex.

It would be convenient if a flash fixing unit is used because the flash fixing unit fixes the image on the recording paper without contacting the recording paper, and it would be possible to make the above described back-feed without the need for the contacting/separating mechanism.

However, the image forming apparatus such as the printer normally uses recording papers having several kinds of sizes, and for example, papers having different widths along a direction perpendicular to the transport direction of the paper are used. For this reason, if the recording paper used has a width smaller than a maximum width, for example, and the first side of the recording paper is fixed by the flash from the flash fixing unit, the flash also leaks to the second side of the recording paper via a region where no recording paper exists. The flash that leaks undergoes a diffused reflection at the toner image on the second side of the recording paper, thereby making the fixing of the second side non-uniform. Therefore, there were problems in that the density of the images on the recording paper finally output from the image forming apparatus become non-uniform and the quality of the images become poor.

SUMMARY OF THE INVENTION

Accordingly, it is a general object of the present invention to provide a novel and useful image forming apparatus in which the problems described above are eliminated.

Another and more specific object of the present invention to provide an image forming apparatus which can carry out a stable fixing process at a high speed with respect to both sides of a recording medium, and form images having a high quality on the recording medium.

Still another object of the present invention is to provide an image forming apparatus comprising a first fixing unit fixing a toner image transferred on a first side of a recording medium by a flash, a second fixing unit fixing a toner image transferred on a second side of the recording medium by a flash, and leak preventing means for preventing the flash of the first fixing unit to the second side and the flash of the second fixing unit to the first side via a region which is within a fixing region of the first and second fixing units and where no recording medium exists due to a size of the recording medium used. According to the image forming apparatus of the present invention, when fixing the first side of the recording medium by the flash from the first fixing unit, it is possible to prevent the flash from leaking to the second side of the recording medium and undergoing diffused reflection at the toner image on the second side via the region where no recording medium exists. As a result, it is possible to vent the fixing of the second side from becoming non-uniform, and the density of the images recorded on the recording medium finally output from the image forming apparatus can stably be maintained, thereby making it possible to maintain a high quality of the image.

Other objects and further features of the present invention will be apparent from the following detailed description when read in conjunction with the accompanying drawings.

DESCRIPTION OF THE PREFERRED EMBODIMENTS

Figure 1:
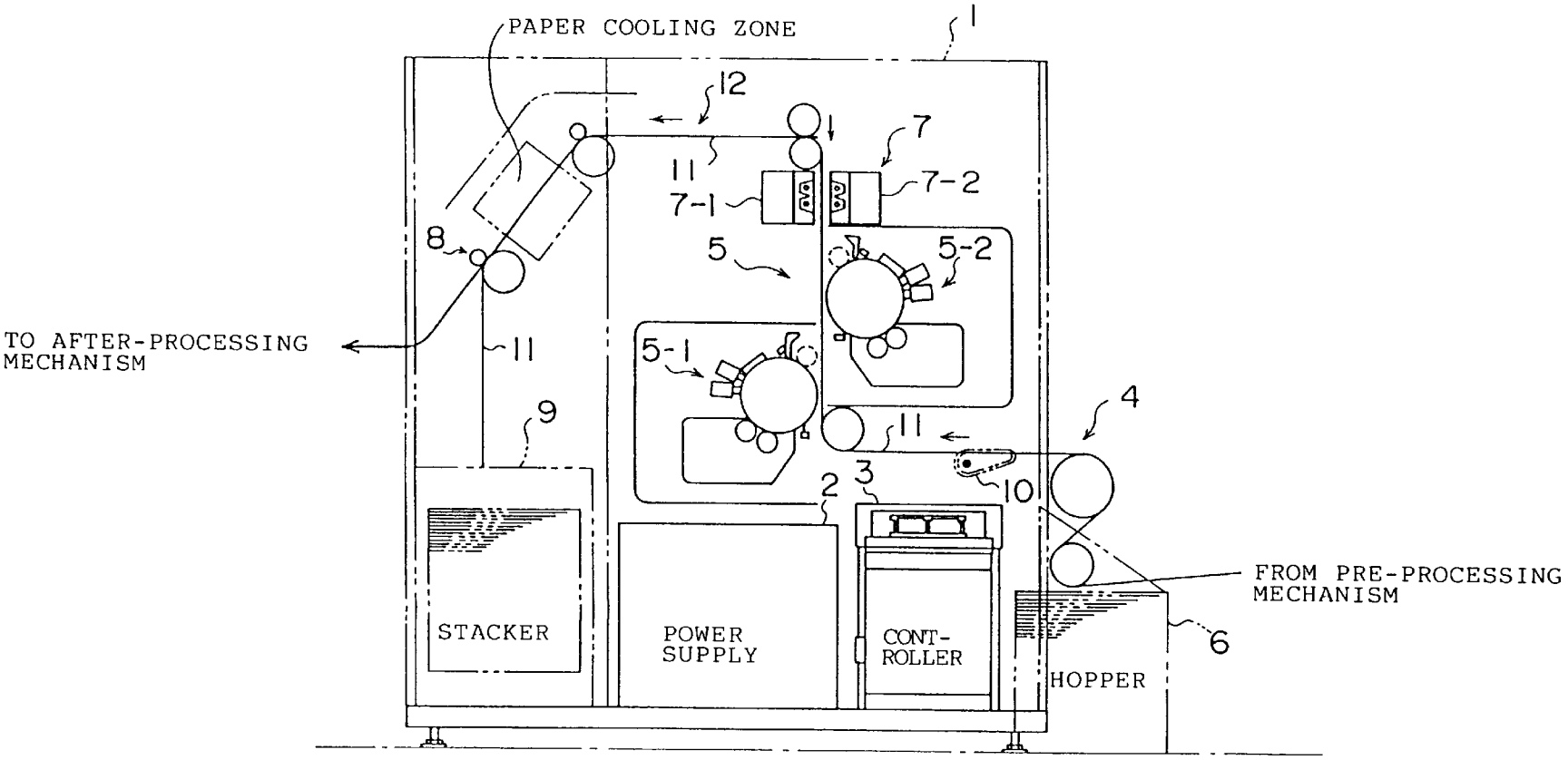
FIG. 1 is a diagram showing the general construction of a first embodiment of an image forming apparatus according to the present invention.

FIG. 1 is a diagram showing the general construction of a first embodiment of an image forming apparatus according to the present invention. In this embodiment, the present invention is applied to a printer employing the electrophotography technique.

A printer 1 shown in FIG. 1 generally includes a power supply 2, a controller 3, a paper supply part 4, a process part 5, a fixing part 7, a paper separation part 8, a stacker 9, and a transport means 10. The controller 3 includes a central processing unit (CPU) or the like which controls the entire printing operation of the printer 1 by controlling various parts of the printer including the paper supply part 4, the process part 5, the fixing part 7 and the paper separation part 8. The paper supply part 8 receives as a recording medium a continuous recording paper 11 from a preprocessing mechanism (not shown), and supplies this recording paper 1 into the printer 1 by a known means. The preprocessing mechanism may be a so-called hopper 6, and this hopper 6 may be provided within the printer 1. The recording paper 11 supplied into the printer 1 is transported by a known transport means 10 (only one shown) in a transport direction indicated by arrows in FIG. 1 along a predetermined transport path 12 within the printer 1.

The process part 5 includes a plurality of process units which transfer images onto the recording paper 11 by the electrophotography technique, under the control of the controller 3. In this embodiment, the process part 5 includes a first process unit 5-1 which transfers a toner image onto a first side of the recording paper 11, and a second process unit 5-2 which transfers a toner image onto a second side of the recording paper 11. Each of the process units 5-1 and 5-2 has a known construction generally including a precharger, an exposure part, a developing part, a transfer part 24, an S.C. discharger, a cleaner, a LED discharger, and a photoconductive body. The operation of the process part 5 is not directly related to the subject matter of the present invention, and a detailed description thereof will be omitted.

Actually, a contacting/separating mechanism (not shown) is provided with respect to the process part 5. This contacting/separating mechanism includes a solenoid, an air pump or the like which controls at least one of the recording paper 11 and each of the process units 5-1 and 5-2 under the control of the controller 3, between a separated state where the recording paper 11 and each of the process units 5-1 and 5-2 are separated from each other and a contacted state where the recording paper 11 and each of the process units 5-1 and 5-2 make contact with each other. When making the back-feed described above, the recording paper 11 and each of the process units 5-1 and 5-2 are controlled to the separated state by the contacting/separating mechanism.

The fixing part 7 fixes the toner image transferred onto the recording paper 11 by a flash fixing under the control of the controller 3, without making contact with the recording paper 11. The separation part 8 supplies the recording paper 11 having the image formed thereon to an after-processing mechanism (not shown) or stacks the recording paper 11 on the stacker 9 within the printer 1, under the control of the controller 3. A perforation is formed at predetermined intervals on the recording paper 11, and the recording paper 11 is successively stacked on the stacker 9 by alternately folding the recording paper 11 in mutually opposite directions along the perforation.

In this embodiment, the fixing part 7 includes first and second flash fixing units (hereinafter simply referred to as first and second fixing units) 7-1 and 7-2 which are arranged at symmetrical positions confronting each other via the recording paper 11 in the transport path 12. The first fixing unit 7-1 fixes the toner image transferred on the first side of the recording paper 11 by a flash, and the second fixing unit 7-2 fixes the toner image transferred on the second side of the recording paper 11 by a flash.

Figure 2:
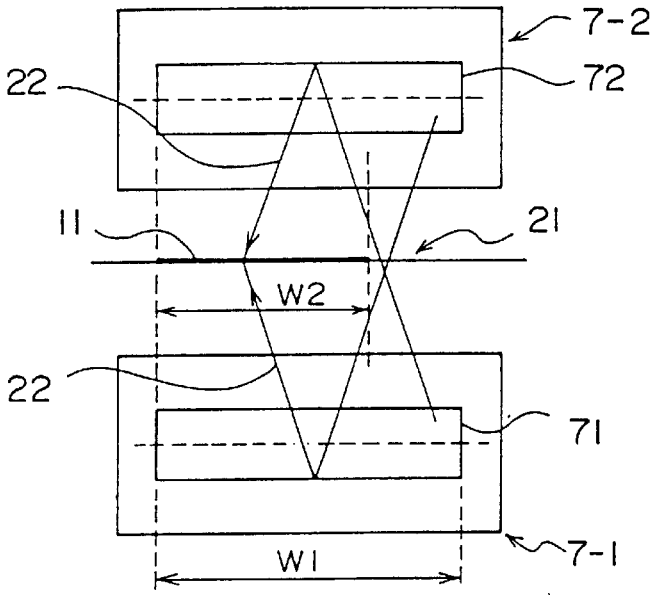
FIG. 2 is a diagram for explaining diffused reflection in a case where fixing units are arranged at symmetrical positions confronting each other via a recording paper in a transport path.

FIG. 2 is a diagram for explaining diffused reflection in a case where the first and second fixing units 7-1 and 7-2 are arranged at symmetrical positions confronting each other via the recording paper 11 in the transport path 12. In FIG. 2, the first fixing unit 7-1 includes a flash lamp 71, and the second fixing unit 7-2 includes a flash lamp 72. A width W1 of each of the flash lamps 71 and 72 in a direction perpendicular to the transport direction of the recording paper 11 is set to a value which is sufficient to carry out the fixing process with respect to the recording paper 11 having a maximum width Wmax used by the printer 1.

In a case where the recording paper 11 used has a width W2 which is smaller than the maximum width Wmax, a region 21 where no recording paper 11 exists is formed between the confronting first and second fixing units 7-1 and 7-2. For this reason, when fixing the first side of the recording paper 11 by the flash, a portion of the flash from the flash lamp 71 is reflected by the flash lamp 72 via the region 21, and leaks to the second side of the recording paper 11. The flash which leaks undergoes diffused reflection at the toner image on the second side of the recording paper 11, and the fixing of the second side becomes non-uniform. As a result, the density of the image formed on the recording paper 11 finally output from the printer 1 may become non-uniform and the quality of the image may become poor. In addition, when fixing the second side of the recording paper 11 by the flash, a portion of the flash from the flash lamp 72 is reflected by the flash lamp 71 via the region 21, and leaks to the first side of the recording paper 11. The flash which leaks undergoes diffused reflection at the toner image on the first side of the recording paper 11, and the fixing of the first side becomes non-uniform. In FIG. 2, a reference numeral 22 indicates diffused reflection lights caused by the confronting flash lamps 71 and 72.

Figure 3:
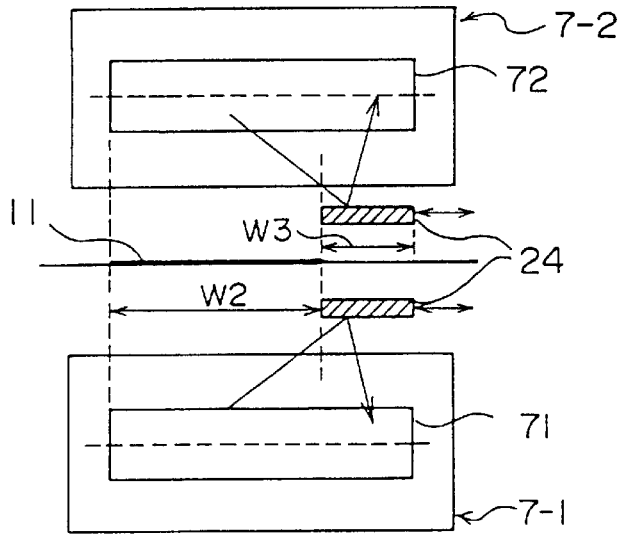
FIG. 3 is a diagram showing a first embodiment of a light blocking member.

Hence, in this embodiment, when the recording paper 11 used has the width W2 which is smaller than the maximum width Wmax, a pair of light blocking members 24 are provided as shown in FIG. 3 so as to block the light in the region 21 which is between the confronting first and second fixing units 7-1 and 7-2 and where no recording paper 11 exists. In FIG. 3, those parts which are the same as those corresponding parts in FIG. 2 are designated by the same reference numerals, and a description thereof will be omitted. Each light blocking member 24 is provided in the transport path 12 of the recording paper 11, and is movable in directions of arrows in FIG. 3 depending on the width W2 of the recording paper 11. In this case, a width W3 of the light blocking member 24 is set so as to satisfy a relationship $W2+W3 \geqq W1$.

As a result, the generation of the diffused reflection lights 22 due to the confronting flash lamps 71 and 72 is prevented by the light blocking members 24, and it is possible to prevent the fixing from becoming non-uniform due to the diffused reflection lights 22. Therefore, it is possible to positively prevent the density of the images formed on the recording paper 11 finally output from the printer 1 from becoming non-uniform, and to positively prevent the quality of the image from deteriorating.

The light blocking members 24 may be constructed to be moved manually or automatically depending on the width W2 of the recording paper 11. When moving the light blocking member 24 manually, it is possible to employ a mechanism similar to a known mechanism which is used in a facsimile machine or the like to slideably adjust paper guide members depending on the width of the recording paper. On the other hand, when automatically moving the light blocking member 24, it is possible to input the paper size when setting the recording paper 11 in the printer 1 or to automatically detect the paper size, for example, so that the controller 3 can recognize the paper size and control a mechanism similar to that used when manually moving the light blocking member 24 depending on the recognized paper size.

Figure 4:
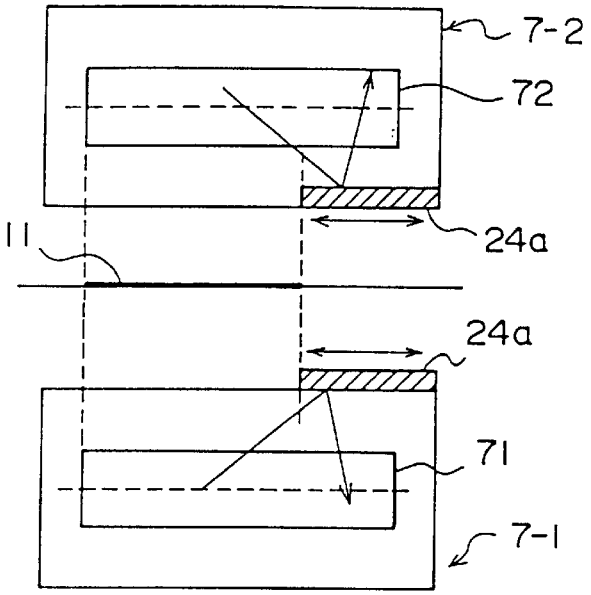
FIG. 4 is a diagram showing a first modification of the light blocking member.

FIG. 4 is a diagram showing a first modification of the light blocking member. In FIG. 4, those parts which are the same as those corresponding parts in FIG. 3 are designated by the same reference numerals, and a description thereof will be omitted. In this modification, a pair of light blocking members 24*a* are provided, so that one light blocking member 24*a* is movably provided on the first fixing unit 7-1 and another light blocking member 24*a* is movably provided on the second fixing unit 7-2. These light blocking members 24*a* may also be constructed to be moved manually or automatically depending on the width W2 of the recording paper 11, similarly as in the case of the light blocking members 24 described above. In this modification, it is possible to obtain a light blocking effect similarly to the embodiment shown in FIG. 3.

Figure 5:
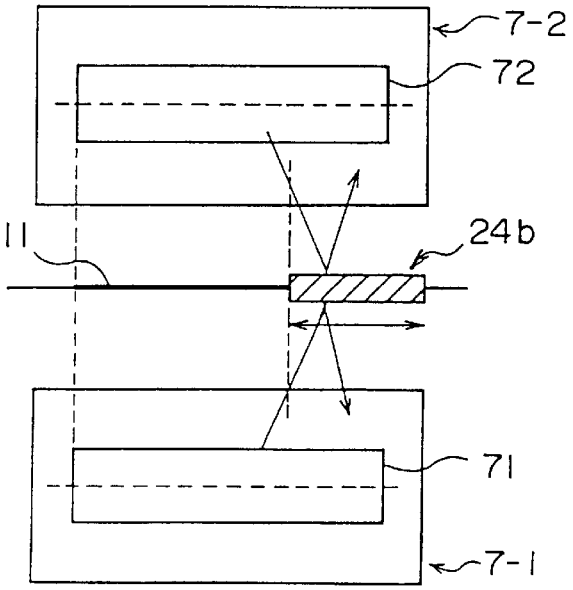
FIG. 5 is a diagram showing a second modification of the light blocking member.

FIG. 5 is a diagram showing a second modification of the light blocking member. In FIG. 5, those parts which are the same as those corresponding parts in FIG. 3 are designated by the same reference numerals, and a description thereof will be omitted. In this modification, a single light blocking member 24*b* is movably provided in the transport path 12 of the recording paper 11. This light blocking member 24*b* may also be constructed to be moved manually or automatically depending on the width W2 of the recording paper 11, similarly as in the case of the light blocking members 24 described above. In this modification, it is possible to obtain a light blocking effect similarly to the embodiment shown in FIG. 3.

Figure 6:
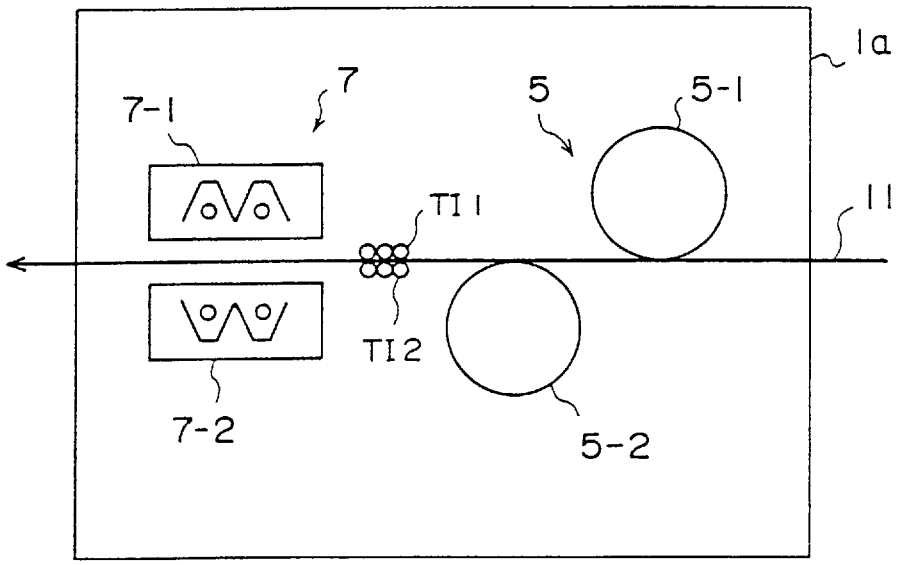
FIG. 6 is a diagram showing an important part of a second embodiment of the image forming apparatus.

Next, a description will be given of a second embodiment of the image forming apparatus according to the present invention. FIG. 6 is a diagram showing an important part of the second embodiment of the image forming apparatus. In FIG. 6, those parts which are the same as those corresponding parts in FIG. 1 are designated by the same reference numerals, and a description thereof will be omitted.

In the first embodiment shown in FIG. 1, the recording paper 11 having the toner image transferred thereon is transported approximately in the vertical direction, but the transport direction of the recording paper 11 at the process part 5 and the fixing part 7 is not limited to the approximate vertical direction. As shown in FIG. 6, the transport direction of the recording paper 11 at the process part 5 and the fixing part 7 in this second embodiment is approximately horizontal, that is, approximately perpendicular to a direction of the gravitational force. In this case, a toner T11 forming the toner image which is transferred onto the first side of the recording paper 11 by the first process unit 5-1 is uneasily scattered from the recording paper 11 by the action of the gravitational force. On the other hand, a toner T12 forming the toner image which is transferred onto the second side of the recording paper 11 by the second process unit 5-2 easily scatters from the recording paper 11 by the action of the gravitational force. For this reason, this embodiment transfers the toner image onto the second side of the recording paper 11 after transferring the toner image onto the first side of the recording paper 11, so that the fixing process can be carried out immediately after transferring the toner image onto the second side of the recording paper 11. Further, if the first and second sides of the recording paper 11 were independently fixed, the toner on the second side would easily scatter when the first side is fixed first, for example. However, this embodiment can suppress the scattering of the toner also from this point of view since the first and second sides of the recording paper 11 are fixed simultaneously.

In addition, compared to a case where the first and second sides of the recording paper 11 are fixed independently, voltages applied to the first and second fixing units 7-1 and 7-2 under the control of the controller 3 can be set small. For example, if it is assumed that a voltage of approximately 1500 V must be applied to each fixing unit when the first and second sides of the recording paper 11 are independently fixed by two fixing units arranged at mutually different positions along the transport direction of the recording paper 11, this embodiment can reduce the voltage applied to the first and second fixing units 7-1 and 7-2 to approximately 1200 V because this embodiment simultaneously fixes the first and second sides of the recording paper 11. This is because when the first and second sides of the recording paper 11 are fixed simultaneously, the fixing energy of the first fixing unit 7-1 slightly affects the second side, and the fixing energy of the second fixing unit 7-2 slightly affects the first side.

Figure 7:
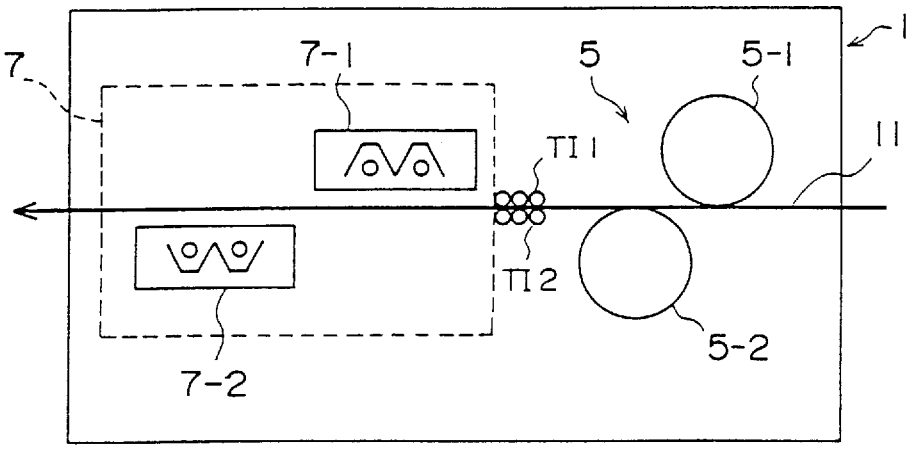
FIG. 7 is a diagram showing an important part of a third embodiment of the image forming apparatus.

FIG. 7 is a diagram showing an important part of a third embodiment of the image forming apparatus according to the present invention. In FIG. 7, those parts which are the same as those corresponding parts in FIG. 6 are designated by the same reference numerals, and a description thereof will be omitted.

In this embodiment, the first fixing unit 7-1 is provided on an upstream side of the second fixing unit 7-2 along the transport direction of the recording paper 11 within a printer 1*a*. In other words, the first and second fixing units 7-1 and 7-2 are arranged at non-symmetrical positions which do not confront each other via the recording paper 11 in the transport path 12. Because each fixing unit does not have a confronting fixing unit, the problem of the diffused reflection of the flash will not occur even if the size of the recording paper 11 used is smaller than the maximum size. The second process unit 5-2 is arranged at a position immediately preceding the first fixing unit 7-1 along the transport direction of the recording paper 11.

Although each fixing unit does not have a confronting fixing unit, the diffused reflection of the flash may be generated by parts which confront the fixing unit depending on the arrangement of the parts. Accordingly, light blocking members similar to the light blocking members 24, 24*a* and 24*b* described above in conjunction with FIGS.3 through 5 may also be provided in this embodiment. But in this case, it is necessary to independently provide the light blocking members depending on the arrangement of each of the fixing units.

Figure 8:
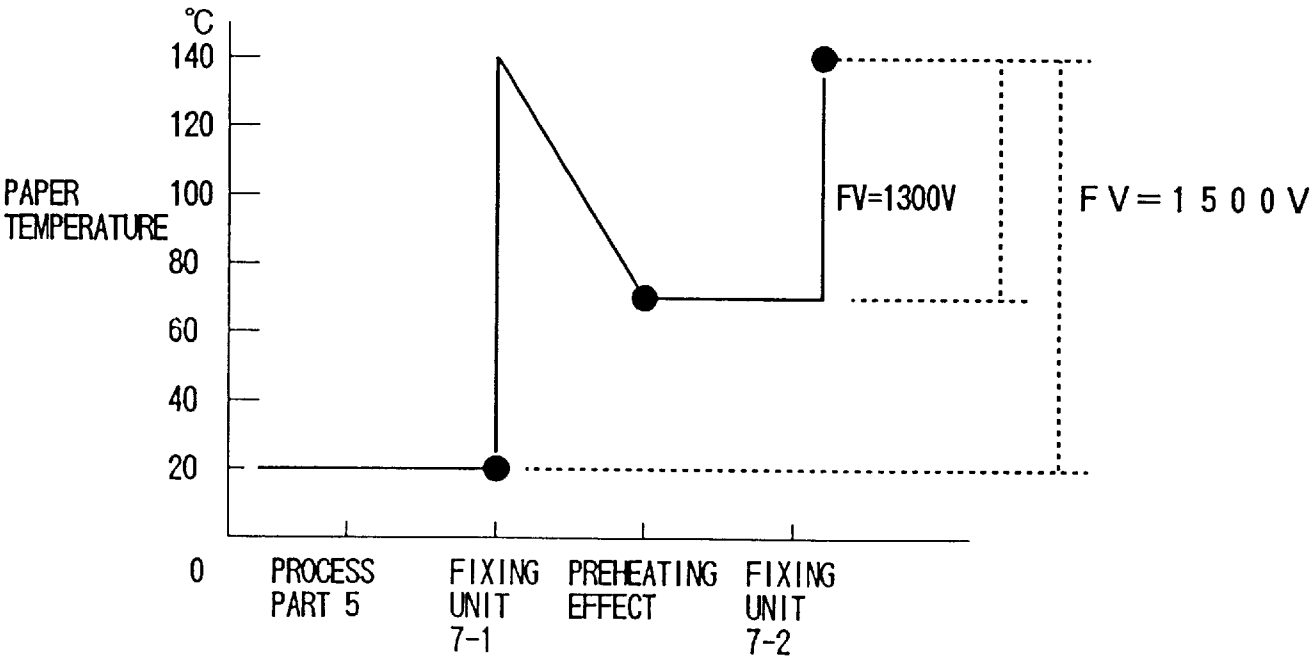
FIG. 8 is a diagram for explaining a voltage applied to a fixing unit in the third embodiment.

FIG. 8 is a diagram for explaining a voltage applied to the fixing unit in this embodiment. In FIG. 8, the ordinate indicates a temperature of the recording paper 11, and the abscissa indicates various parts of the printer 1*a* arranged at different positions along the transport direction of the recording paper 11.

As shown in FIG. 8, if the temperature of the recording paper 11 obtained from the process part 5 is approximately 20° C., the temperature after the fixing with respect to the first side of the recording paper 11 rises to approximately 140° C. by applying a voltage FV=1500 V to the first fixing unit 7-1. By the time when the recording paper 11 reaches the second fixing unit 7-2, the temperature of the recording paper 11 has not yet fallen to the original temperature of approximately 20° C. because the second fixing unit 7-2 is provided immediately after the first fixing unit 7-1 along the transport direction of the recording paper 11. In other words, due to a preheating effect caused by the fixing process carried out by the first fixing unit 7-2, the temperature of the recording paper 11 supplied to the second fixing unit 7-2 is raised to approximately 70° C. from the original temperature of approximately 20° C. For this reason, it is possible to carry out a similar fixing process as the first fixing unit 7-1 by applying to the second fixing unit 7-2 a voltage which is smaller than the voltage FV=1500 V. More particularly, the temperature after the fixing process is carried out with respect to the second side of the recording paper 11 rises to approximately 140° C. by applying a voltage FV=1300 V to the second fixing unit 7-2. Hence, according to this embodiment, it is possible to reduce the power consumption of the fixing part 7 by the preheating effect described above.

Figure 9:
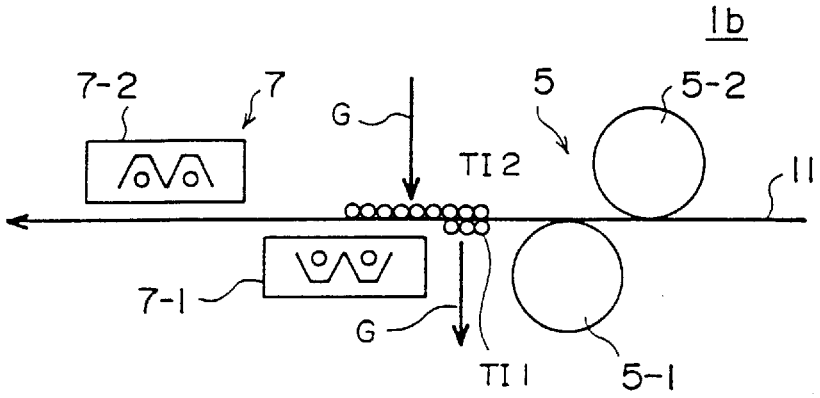
FIG. 9 is a diagram showing an important part of a fourth embodiment of the image forming apparatus.

FIG. 9 is a diagram showing an important part of a fourth embodiment of the image forming apparatus according to the present invention. In FIG. 9, those parts which are the same as those corresponding parts in FIG. 7 are designated by the same reference numerals, and a description thereof will be omitted.

In this embodiment, the first fixing unit 7-1 is provided on an upstream side of the second fixing unit 7-2 along the transport direction of the recording paper 11 within a printer 1*b*. In other words, the first and second fixing units 7-1 and 7-2 are arranged at non-symmetrical positions which do not confront each other via the recording paper 11 in the transport path 12. Because each fixing unit does not have a confronting fixing unit, the problem of the diffused reflection of the flash will not occur even if the size of the recording paper 11 used is smaller than the maximum size. The first process unit 5-1 is arranged at a position immediately preceding the first fixing unit 7-1 along the transport direction of the recording paper 11.

The toner T12 forming the toner image which is transferred onto the second side of the recording paper 11 by the second process unit 5-2 is uneasily scattered from the recording paper 11 by the action of the gravitational force G. On the other hand, a toner TI1 forming the toner image which is transferred onto the first side of the recording paper 11 by the first process unit 5-1 easily scatters from the recording paper 11 by the action of the gravitational force G. For this reason, this embodiment transfers the toner image onto the first side of the recording paper 11 after transferring the toner image onto the second side of the recording paper 11, so that the fixing process can be carried out immediately after transferring the toner image onto the first side of the recording paper 11. Further, even though the first and second sides of the recording paper 11 are independently fixed, the toner TI2 on the second side uneasily scatters when the first side is fixed first, and the scattering of the toner is suppressed. In other words, this embodiment can suppress the scattering of the toner by first fixing the toner which easily scatters.

Figure 10:
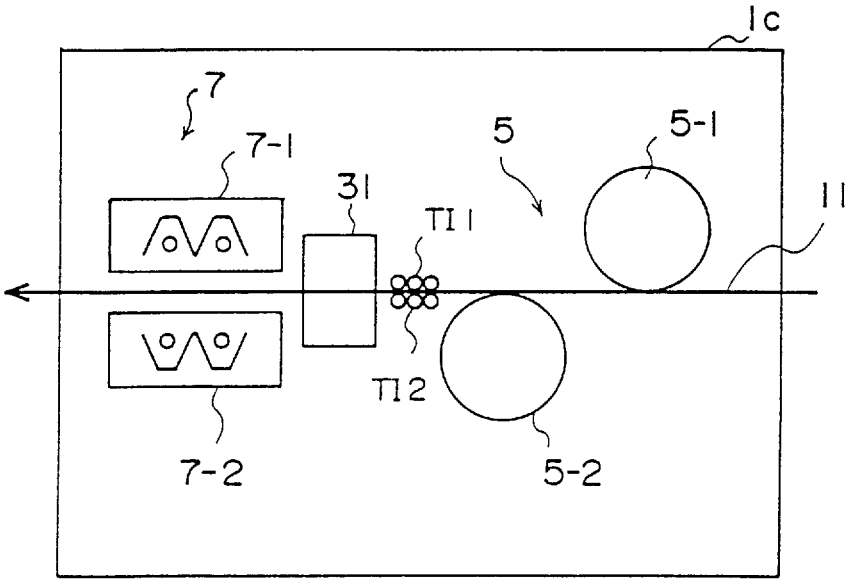
FIG. 10 is a diagram showing an important part of a fifth embodiment of the image forming apparatus.

FIG. 10 is a diagram showing an important part of a fifth embodiment of the image forming apparatus according to the present invention. In FIG. 10, those parts which are the same as those corresponding parts in FIG. 6 are designated by the same reference numerals, and a description thereof will be omitted.

In this embodiment, a preheating unit 31 is provided between the process part 5 and the fixing part 7 within a printer 1*c*, as shown in FIG. 10. The preheating unit 31 raises the temperature of the recording paper 11 received from the process part 5 before supplying the recording paper 11 to the fixing part 7. For this reason, the fixing energy at the fixing part 7 can be set small compared to the case where no preheating unit 31 is provided. In addition, it is possible to prevent damage to the recording paper 11 due to the large fixing energy of the fixing part 7.

Figure 11:
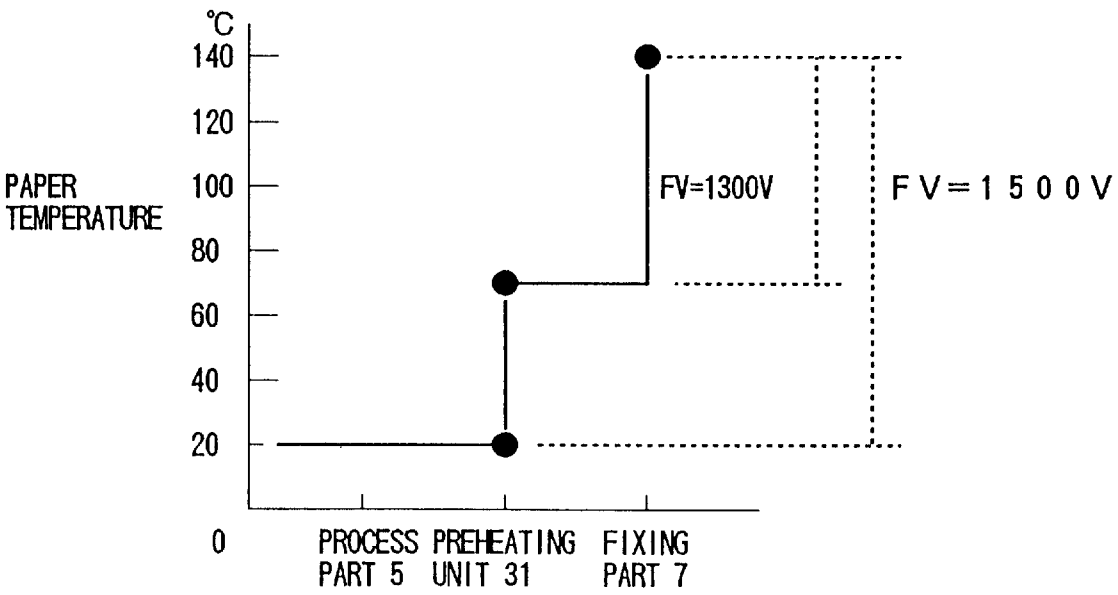
FIG. 11 is a diagram for explaining a voltage applied to a fixing unit in the fifth embodiment.

FIG. 11 is a diagram for explaining a voltage applied to the fixing part in this embodiment. In FIG. 11, the ordinate indicates the temperature of the recording paper 11, and the abscissa indicates various parts of the printer 1*c* arranged at different positions along the transport direction of the recording paper 11.

As shown in FIG. 11, if the temperature of the recording paper 11 obtained from the process part 5 is approximately 20° C., the temperature of the recording paper 11 rises to approximately 70° C. when the recording paper 11 is preheated by the preheating unit 31. By the time the recording paper 11 reaches the fixing part 7, the temperature of the recording paper 11 is maintained to approximately 70° C. because the fixing part 7 is provided immediately subsequent to the preheating unit 31 along the transport direction of the recording paper 11. In other words, the temperature of the recording paper 11 supplied to the fixing part 7 is raised to approximately 70° C. from the original temperature of approximately 20° C. due to the preheating effect of the preheating unit 31. For this reason, by applying to the fixing part 7 a voltage smaller than the voltage FV=1500 V, the fixing part 7 can carry out a fixing process similar to that carried out when no preheating unit 31 is provided and the voltage FV=1500 V is applied. More particularly, the temperature of the recording paper 11 rises to approximately 140° C. after the fixing process by applying a voltage FV=1300 V to the first and second fixing units 7-1 and 7-2 of the fixing part 7. Therefore, according to this embodiment, it is possible to prevent damage to the recording paper 11 caused by the high fixing energy of the fixing part 7 due to the preheating effect.

Figure 12:
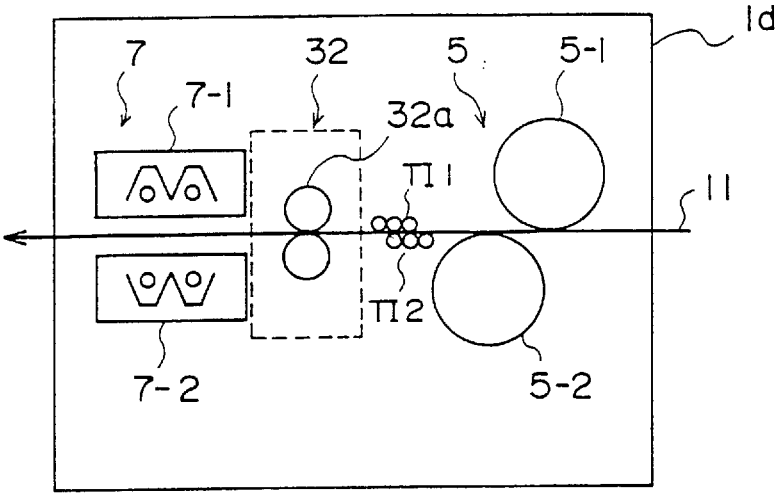
FIG. 12 is a diagram showing an important part of a first modification of the fifth embodiment of the image forming apparatus.

FIG. 12 is a diagram showing an important part of a first modification of the fifth embodiment of the image forming apparatus. In FIG. 12, those parts which are the same as those corresponding parts in FIG. 10 are designated by the same reference numerals, and a description thereof will be omitted.

In this modification, a preheating unit 32 within a printer 1*d* includes a pair of heat rollers 32*a*. In this case, the heat rollers 32*a* make direct contact with the recording paper 11. Hence, the heat is efficiently transferred to the recording paper 11, and it is possible to reduce the size of the preheating unit 32.

Figure 13:
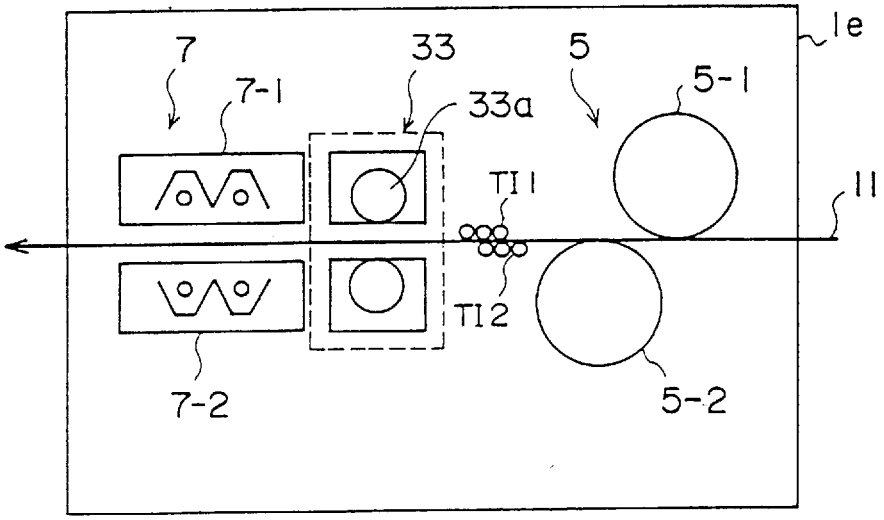
FIG. 13 is a diagram showing an important part of a second modification of the fifth embodiment of the image forming apparatus.

FIG. 13 is a diagram showing an important part of a second modification of the fifth embodiment of the image forming apparatus. In FIG. 13, those parts which are the same as those corresponding parts in FIG. 10 are designated by the same reference numerals, and a description thereof will be omitted.

In this modification, a preheating unit 33 within a printer 1*e* includes a pair of halogen lamps 33*a*. In this case, it is possible to suppress the generation of the flash energy shock and to suppress the heat discharge by using the halogen lamps 33*a* and employing an oven structure. Hence, the preheating of the recording paper 11 can be made efficiently without contacting the recording paper 11, using the preheating unit 33 which has a reduced size.

Figure 14:
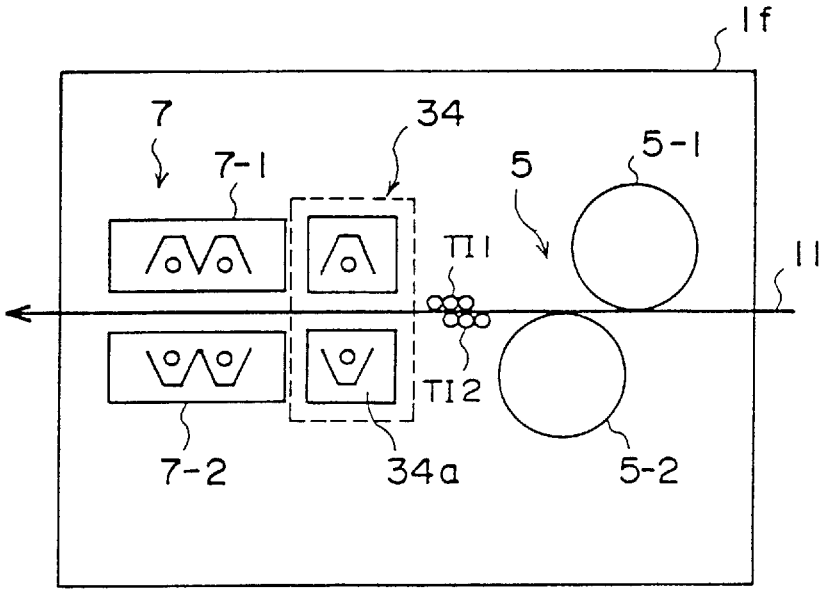
FIG. 14 is a diagram showing an important part of a third modification of the fifth embodiment of the image forming apparatus.

FIG. 14 is a diagram showing an important part of a third modification of the fifth embodiment of the image forming apparatus. In FIG. 14, those parts which are the same as those corresponding parts in FIG. 10 are designated by the same reference numerals, and a description thereof will be omitted.

In this modification, a preheating unit 34 within a printer if includes a pair of flash light sources 34*a*. In this case, the preheating of the recording paper 11 can be made efficiently without contacting the recording paper 11, using the preheating unit 34 which has a reduced size.

In the fifth embodiment described above, the first and second fixing units 7-1 and 7-2 of the fixing part 7 are arranged at mutually confronting positions. However, the preheating unit 31 may of course be provided in the case where the first and second fixing units 7-1 and 7-2 are arranged at positions which do not confront each other as in the case of the third and fourth embodiments shown in FIGS.9 and 10.

Figure 15:
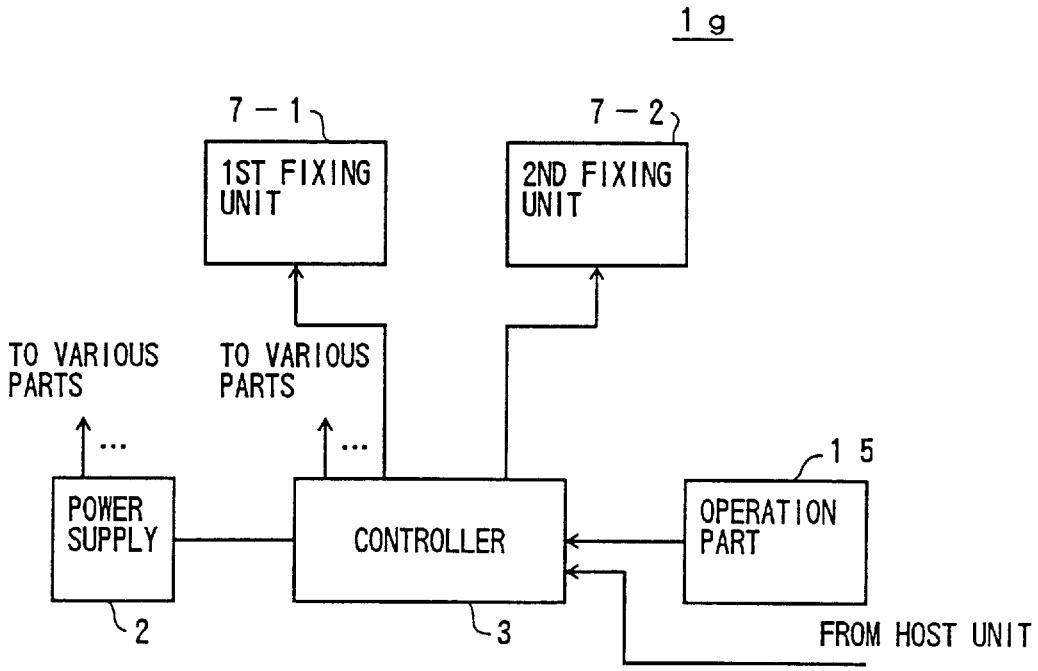
FIG. 15 is a system block diagram showing an important part of a sixth embodiment of the image forming apparatus according to the present invention.

FIG. 15 is a diagram showing an important part of a sixth embodiment of the image forming apparatus according to the present invention. In FIG. 15, those parts which are the same as those corresponding parts in FIG. 1 are designated by the same reference numerals, and a description thereof will be omitted. An operation part 15 is provided to input information related to the operation mode or the like to a printer 1*g*.

If the voltage applied to the fixing part 7 is fixed and the print rate on the recording paper 11 is low, the heat absorption of the flash energy by the toner image becomes too high, and a void or the like is easily generated. Hence, in this embodiment, the print rate is calculated based on print data from a host unit (not shown) or the like, and the voltage applied to the fixing part 7 is controlled depending on this print rate. As a result, it is possible to carry out the fixing process at a minimum required fixing energy depending on the print rate, and the generation of the void or the like is prevented. Consequently, it is possible to form an image having an extremely high quality on the recording paper 11.

Figure 16:
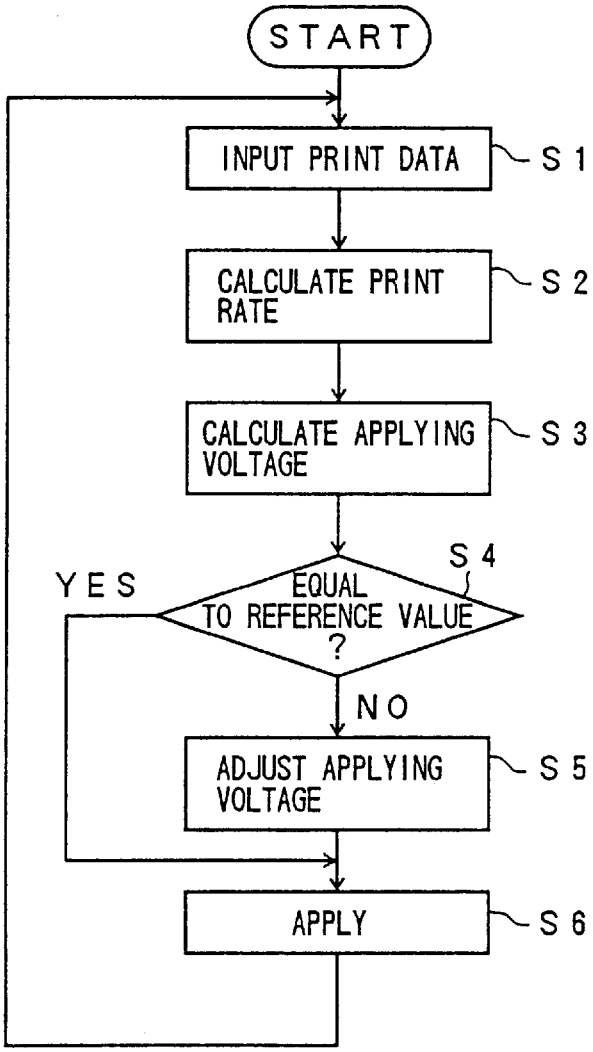
FIG. 16 is a flow chart for explaining the operation of the sixth embodiment.

FIG. 16 is a flow chart for explaining the operation of the controller 3 in this embodiment. For the sake of convenience, FIG. 16 only shows the control of the fixing process with respect to the first side of the recording paper 11. But actually, the control of the fixing process with respect to the second side of the recording paper 11 is carried out similarly, independently of the control with respect to the first side of the recording paper 11.

In FIG. 16, a step S1 inputs the print data from the host unit, and a step S2 calculates the print rate based on the print data. In this case, the print rate may be calculated for each line or, calculated for every predetermined number of lines. A step S3 calculates a voltage to be applied to the first fixing unit 7-1 of the fixing part 7 based on the print rate calculated in the step S2, for each line or for every predetermined number of lines. For example, the voltage applied to the first fixing unit 7-1 is approximately 1700 V when the print rate is 20%, and the voltage applied to the first fixing unit 7-1 is approximately 1500 V when the print rate is 4%.

A step S4 decides whether or not the calculated voltage is equal to a reference value. This reference value is the voltage presently applied to the first fixing unit 7-1 of the fixing part 7. If the decision result in the step S4 is NO, a step S5 adjusts the voltage to the voltage calculated in the step S3, and a step S6 applies the voltage adjusted in the step S5 to the first fixing unit 7-1 of the fixing part 7. On the other hand, if the decision result in the step S4 is YES, no voltage adjustment is made, and the step S6 continues to apply the voltage having the reference value to the first fixing unit 7-1 of the fixing part 7.

When adjusting the voltages applied from the controller 3, it is desirable to independently control the voltages applied to the first and second fixing units 7-1 and 7-2 depending on the relative positions of the first and second fixing units 7-1 and 7-2, as in the case of the embodiments described above.

Figure 17:
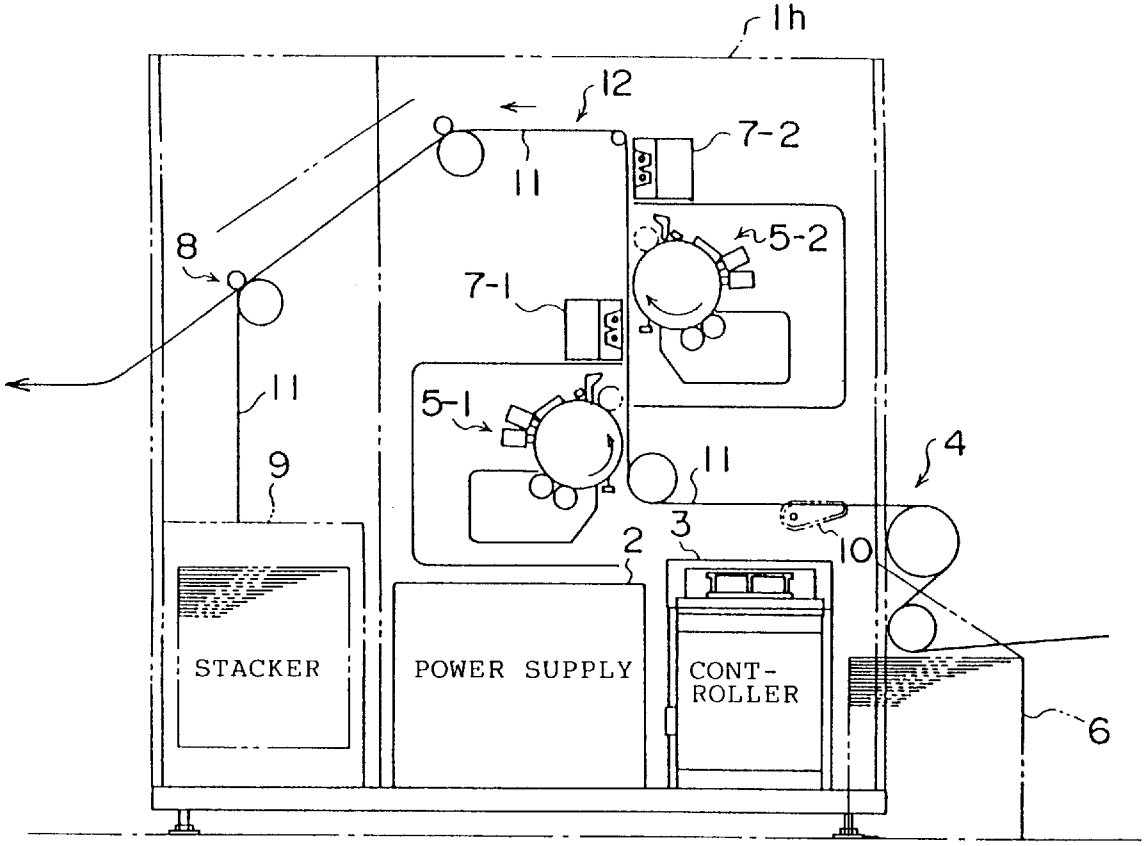
FIG. 17 is a diagram showing the general construction of a seventh embodiment of the image forming apparatus according to the present invention.

FIG. 17 is a diagram showing the general construction of a seventh embodiment of the image forming apparatus according to the present invention. In FIG. 17, those parts which are the same as those corresponding parts in FIG. 1 are designated by the same reference numerals, and a description thereof will be omitted.

In a printer 1h shown in FIG. 17, the first fixing unit 7-1 of the fixing part 7 is arranged on the downstream side of the first process unit 5-1 of the process part 5 along the transport direction of the recording paper 11 but on the upstream side of the second process unit 5-2 along the transport direction of the recording paper 11. In addition, the second fixing unit 7-2 of the fixing part 7 is arranged on the downstream side of the second process unit 5-2 of the process part 5 along the transport direction of the recording paper 11. In this embodiment, it is possible to obtain effects similar to those obtained in the embodiments shown in FIGS. 7 and 9.

Further, the present invention is not limited to these embodiments, but various variations and modifications may be made without departing from the scope of the present invention.

What is claimed is:

1. An image forming apparatus comprising:

a first fixing unit fixing a toner image transferred on a first side of a recording medium by a flash;

a second fixing unit fixing a toner image transferred on a second side of the recording medium by a flash; and leak preventing means for preventing the flash of the first fixing unit to the second side and the flash of the second fixing unit to the first side with respect to a region which is within a fixing region of the first and second fixing units and where no recording medium exists due to a size of the recording medium used.

2. The image forming apparatus as claimed in claim 1, wherein said leak preventing means includes a light blocking member which blocks a region which is within the fixing region and corresponds to a difference between at least a maximum size of the recording medium and the size of the recording medium used.

3. The image forming apparatus as claimed in claim 2, wherein said light blocking member is provided in a transport path of the recording medium.

4. The image forming apparatus as claimed in claim 2, wherein said light blocking member is provided independently with respect to the first and second fixing units.

5. The image forming apparatus as claimed in claim 2, wherein said light blocking member is made up of a first light blocking member provided on the first fixing unit, and a second light blocking member provided on the second fixing unit.

6. The image forming apparatus as claimed in claim 2, wherein said first and second fixing units are provided at symmetrical positions which confront each other via the recording medium.

7. The image forming apparatus as claimed in claim 2, wherein said first and second fixing units are provided at non-symmetrical positions which do not confront each other via the recording medium.

8. The image forming apparatus as claimed in claim 2, wherein said first fixing unit is arranged at a position which fixes the first side prior to the fixing of the second side by said second fixing unit along a transport direction of the recording medium, and a direction in which gravitational force acts on a toner forming the toner image formed on the first side does not penetrate the recording medium.

9. The image forming apparatus as claimed in claim 2, which further comprises:

control means for controlling voltages applied to the first and second fixing units based on print rates with respect to the first and second sides of the recording medium.

10. The image forming apparatus as claimed in claim 2, which further comprises:

a preheating unit, arranged on an upstream side of the first and second fixing units along a transport direction of the recording medium, preheating the first and second sides of the recording medium.

11. The image forming apparatus as claimed in claim 1, wherein said first and second fixing units are provided at symmetrical positions which confront each other with respect to the recording medium.

12. The image forming apparatus as claimed in claim 1, wherein said first and second fixing units are provided at non-symmetrical positions which do not confront each other with respect to the recording medium.

13. The image forming apparatus as claimed in claim 12, which further comprises:

a process part transferring the toner images on the first and second sides of the recording medium, and a voltage applied to one of the first and second fixing units closer to said process part along a transport direction of the recording medium is set greater than or equal to a voltage applied to the other of the first and second fixing units.

14. The image forming apparatus as claimed in claim 12, which further comprises:

control means for controlling voltages applied to the first and second fixing units based on print rates with respect to the first and second sides of the recording medium.

15. The image forming apparatus as claimed in claim 12, which further comprises:

a preheating unit, arranged on an upstream side of the first and second fixing units along a transport direction of the recording medium, preheating the first and second sides of the recording medium.

16. The image forming apparatus as claimed in claim 1, wherein said first fixing unit is arranged at a position which fixes the first side prior to the fixing of the second side by said second fixing unit along a transport direction of the recording medium, and a direction in which gravitational force acts on a toner forming the toner image formed on the first side does not penetrate the recording medium.

17. The image forming apparatus as claimed in claim 1, which further comprises:

control means for controlling voltages applied to the first and second fixing units based on print rates with respect to the first and second sides of the recording medium.

18. The image forming apparatus as claimed in claim 1, which further comprises:

a preheating unit, arranged on an upstream side of the first and second fixing units along a transport direction of the recording medium, preheating the first and second sides of the recording medium.

19. The image forming apparatus as claimed in claim 18, wherein said preheating unit is selected from a group consisting of a flash fixing unit, an oven mechanism and a heat roller.

20. The image forming apparatus as claimed in claim 1, wherein said recording medium is a continuous recording paper.

* * * * *